US008430719B2

(12) United States Patent
Katayama et al.

(10) Patent No.: US 8,430,719 B2
(45) Date of Patent: Apr. 30, 2013

(54) POLISHING PAD

(75) Inventors: Takashi Katayama, Kurashiki (JP); Tetsuya Watanabe, Osaka (JP); Yukio Goto, Toyonaka (JP); Shinya Kato, Kurashiki (JP); Toshiyasu Yajima, Shinagawa-ku (JP)

(73) Assignees: Kuraray Co., Ltd., Kurashiki-shi (JP); Maruishi Sangyo Co., Ltd., Tokyo (JP)

( * ) Notice: Subject to any disclaimer, the term of this patent is extended or adjusted under 35 U.S.C. 154(b) by 0 days.

(21) Appl. No.: 13/444,376

(22) Filed: Apr. 11, 2012

(65) Prior Publication Data

US 2012/0196515 A1 Aug. 2, 2012

Related U.S. Application Data

(63) Continuation of application No. PCT/JP2010/066843, filed on Sep. 28, 2010.

(30) Foreign Application Priority Data

Oct. 14, 2009 (JP) ..... 2009-237120

(51) Int. Cl.
*B24B 1/00* (2006.01)

(52) U.S. Cl.
USPC ..... 451/41; 451/532

(58) Field of Classification Search ..... 451/41, 451/285, 532
See application file for complete search history.

(56) References Cited

U.S. PATENT DOCUMENTS 5,021,283 A * 6/1991 Takenaka et al. ..... 428/116
5,725,420 A * 3/1998 Torii ..... 451/285

FOREIGN PATENT DOCUMENTS

| | | |
|---|---|---|
| JP | 09-117855 | 5/1997 |
| JP | 2007-185718 | 7/2007 |
| JP | 2008-290181 | 12/2008 |
| JP | 2009-191376 | 8/2009 |

OTHER PUBLICATIONS

International Preliminary Report on Patentability and Written Opinion issued May 24, 2012 in Application No. PCT/JP2010/066843 (English Translation).
International Search Report issued Oct. 26, 2010 in PCT/JP2010/066843 filed Sep. 28, 2010.

* cited by examiner

*Primary Examiner* — Maurina Rachuba
(74) *Attorney, Agent, or Firm* — Oblon, Spivak, McClelland, Maier & Neustadt, L.L.P.

(57) ABSTRACT

To provide a polishing pad (14) useful for polishing semiconductor materials having a high hardness. The polishing pad (14) is used for polishing a workpiece (16) in combination with loose grains and comprises a polishing surface (15) comprising a textile of high-tenacity organic fibers, the fiber has a tenacity of not lower than 15 cN/dtex. In the textile, the high-tenacity organic fiber may have a single fiber fineness within the range between 0.3 dtex and 15 dtex, or a total fineness of within the range between 3 dtex and 3,000 dtex. The fiber may include, for example, a fully-aromatic polyester fiber.

8 Claims, 1 Drawing Sheet

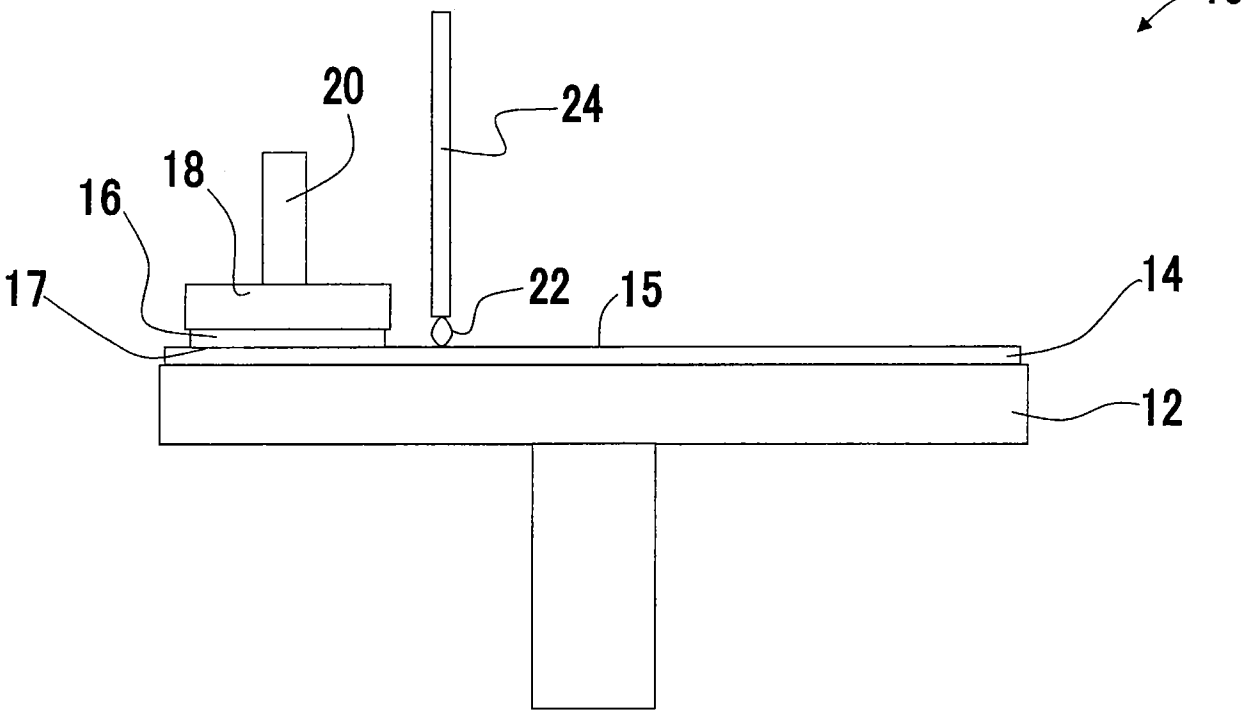
10
14
12
15
24
22
20
18
16
17

POLISHING PAD

CROSS REFERENCE TO THE RELATED APPLICATIONS

This application is a continuation application, under 35 U.S.C. §111(a), of international application No. PCT/JP2010/066843, filed on Sep. 28, 2010, which claims priority to Japanese Patent Application No. 2009-237120, filed on Oct. 14, 2009, the entire disclosure of which is herein incorporated by reference in their entirety into this application.

FIELD OF THE INVENTION

The present invention relates to a polishing pad characterized in that a polishing surface for polishing a workpiece is made of a textile of high-tenacity organic fibers, and particularly relates to a polishing pad useful for lapping and/or polishing semiconductor materials and metals.

BACKGROUND ART

Although single crystal silicon wafers have been mainly used as semiconductor substrates, they have been becoming incompatible with devices such as LED-related devices and highly efficient power devices containing next-generation semiconductor substrates.

In particular, under the circumstances that require higher proof pressure (improvement in dependability) and lower ON resistance (reduction in loss), semiconductor devices comprising various compound semiconductors including SiC, substrates of sapphire- or ceramic type have been developed and mass-produced.

Among them, SiC and GaN, as compared with Si, have a large wideband gap and are operable under high temperatures (Si operates at 175° C. whereas SiC operates at 200 to 300° C.). Further, SiC and GaN are capable of achieving low resistance because their dielectric breakdown field strength is more than 10 times of that of Si. Therefore, SiC and GaN are expected to be mainly used in the near future instead of the silicon.

Wafer materials with high hardness, such as monocrystal and polycrystal materials (SiC, sapphire, others), are required to be highly flattened as well as have high quality surface. In such cases, these materials are generally subjected to several lapping and polishing processes (e.g., lapping, rough polishing, middle polishing, final polishing, etc.) before finish.

Nowadays, metals such as tin, copper and iron are mainly used as a lapping platen. Moreover pads of urethane type, nonwoven fabric type, suede type, etc. are used as a polishing pad. Furthermore, loose abrasive grains, such as fine diamond abrasive grains, colloidal-silica abrasive grains, cerium sulfide abrasive grains, and alumina abrasive grains are used as abrasive grains for polishing.

However, in the case of using such wafer materials with high hardness, it is very difficult to make these materials have high flatness as well as high quality surface by lapping and polishing processes with a conventional polishing pad. Furthermore, it is known that the time required for lapping and polishing processes becomes longer in such hard wafer materials. In general, longer polishing time during the processing deteriorates yield because of difficulty in achieving high planarization and high quality surface. That is, since conventional polishing pads cannot improve polishing rate and further deteriorate in productivity, lapping and polishing systems which can raise the polishing rate are required. Moreover, since flatness control for planarizing a metal platen needs troublesome labor, the lapping and polishing system which can save labor management is required.

For example, Patent Document 1 (JP Laid-open Patent Publication No. 9-117855) discloses a polishing pad having a plurality of pores for holding abrasive materials polishing a workpiece, wherein the polishing pad has grooves on the polishing surface which polishes the above-mentioned workpiece. This reference describes application of foamed polyurethane as a hard layer of the polishing pad.

In the above-mentioned polishing pad, such grooves are effectively used for removing a semiconductor wafer from the polishing pad after polishing and make it possible to control the holding capacity of the abrasive materials.

PATENT DOCUMENT

[Patent Document 1] JP Laid-open Patent Publication No. 9-117855

DISCLOSURE OF THE INVENTION

Problems to be Solved by the Invention

However, in the polishing pad of Patent Document 1, the urethane layer itself will be degraded by loose grains, such as diamond grains, in the midst of the lapping.

Moreover, polishing processes to make high hardness wafer substrates have higher flatness and higher quality surface require for very complicated work and need longer time for each of the polishing processes. Although various attempts for shortening this processing time and raising productivity are made, in particular for high hardness wafer substrates, difficulty in polishing such high hardness wafer substrates makes their polishing rate lower, resulting in reduced productivity.

The object of the present invention is to provide a polishing pad excellent in resistance to cutting and abrasion, having moderate affinity with loose abrasive grains, and being capable of effectively polishing workpieces, such as high hardness wafers and metals, to increase productivity.

Means for Solving the Problems

As a result of intensive studies conducted by the inventors of the present invention to achieve the above objects, it has been found that (i) by applying loose abrasive grains to a polishing pad comprising as a polishing surface comprising a textile which comprises high-tenacity fibers having a specific tenacity and has a specific covering factor, degradation of the polishing pad caused by these abrasive grains can be inhibited as much as possible, that (ii) even if a workpiece to be polished has high hardness, combination of the polishing pad comprising such a textile and loose grains make it possible to raise the polishing rate as well as to ensure high flatness and high quality surface of the workpiece, and that (iii) such a polishing pad is capable of shortening the seasoning time which was required of the conventional lapping abrasion. The present invention has now completed by the above findings.

That is, the present invention provides a polishing pad for polishing a workpiece to be polished in combination with loose abrasive grains. The pad comprises a polishing surface comprising a textile of high-tenacity organic fibers having a tenacity of not lower than 15 cN/dtex, the textile having a cover factor "K" of the range between 700 and 4,000, the cover factor "K" being expressed by the following formula (1).

$$K=N1\times\sqrt{T1}+N2\times\sqrt{T2} \quad (1)$$

N1: Density of warp (yarns/inch)
N2: Density of weft (yarns/inch)
T1: The total fineness of warp (dtex)
T2: The total fineness of weft (dtex)

The above-mentioned high-tenacity organic fiber may have an elastic modulus of 300 cN/dtex or greater. The single fiber fineness of the high-tenacity organic fiber may be about 0.3 to 15 dtex, and the total fineness of a yarn of the above high-tenacity organic fiber may be about 3 to 3,000 dtex. Preferable examples of such high-tenacity organic fiber may include a fully-aromatic polyester fiber.

The above-mentioned polishing pad can be used in various polishing manners, and may be used, for example, as a polishing pad for lapping, MCP, or CMP systems.

Furthermore, the present invention includes a polishing machine which comprises a polishing pad, a carrier for holding a workpiece to be polished and contacting the workpiece with the polishing pad, loose abrasive grains supplied to the polishing surface between the polishing pad and the workpiece. The polishing pad is the polishing pad mentioned above. The polishing pad and the workpiece are relatively moved in the presence of the loose abrasive grains Moreover, the present invention also includes a method for using a polishing pad for polishing a workpiece to be polished. The above-mentioned method comprises contacting the above-mentioned polishing pad with a workpiece to be polished, supplying loose grains to between the polishing pad and the workpiece, moving the polishing pad relative to the workpiece in the presence of the loose grains.

Effect of the Invention

According to the present invention, it is possible to raise polishing rate when processing high hardness semiconductor material or performing precision metalworking operations and to make the polished surface have high flatness and high quality.

Moreover, since the polishing pad of the present invention is capable of polishing with high efficiency, such pad is applicable to various polishing processes and to reduce the number of processes for polishing.

Moreover, in the polishing pad of the present invention, it is possible to improve durability of the polishing pad itself, as well as to attain shortening of the seasoning time in the lapping process.

Furthermore, by using the polishing pad of the present invention, even if the flat property of a platen of the polishing machine is not severely managed, the polishing machine can achieve improved polishing.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims.

FIG. 1 is a schematic sectional view for explaining one embodiment of the polishing machine of the present invention.

DETAILED DESCRIPTION OF THE INVENTION

[Polishing Pad]

The polishing pad of the present invention is used for polishing a surface of a workpiece to be polished in combination with loose abrasive grains, and comprises a polishing surface comprising a textile of high-tenacity organic fibers. From the viewpoint of inhibiting degradation of the polishing pad caused by the loose grains, the tenacity of the high-tenacity organic fibers needs to be 15 cN/dtex or greater, and is preferably 18 cN/dtex or greater, and more preferably 20 cN/dtex or greater. Although the upper limit of the tenacity is not limited to a specific one, the tenacity may be 100 cN/dtex or less in many cases. It should be noted that the polishing pad comprising organic fibers having a tenacity of 15 cN/dtex or less may become useless during the polishing process in some cases because of the fiber cutting.

Moreover, from the viewpoint of inhibiting aggregation of the loose grains, the elastic modulus of the high-tenacity organic fibers may be 300 cN/dtex or greater (for example, about 350 to 2,000 cN/dtex), and may be preferably 400 cN/dtex or greater (for example, about 450 to 1,800 cN/dtex).

By using the textile of such high-tenacity organic fibers as a polishing pad, it is possible (1) not only to make the polished surface of the workpiece have high flatness, (2) but also to achieve high polishing rate and high quality surface by changing polishing abrasive grain depending on the nature of various workpieces.

The high-tenacity organic fiber used in the present invention is not limited to a specific one as long as the tenacity of the fiber is within the above-defined range. Examples of the high-tenacity organic fibers may include fully-aromatic polyamide fibers, fully-aromatic polyester fibers, ultrahigh molecular weight polyethylene fibers, polyvinyl alcohol fibers, heteroaromatic fibers, and the like. These fibers may be monocomponent fibers or composite fibers of two or more components. Moreover, it is also possible to form a textile from threads of different fiber species with each other in combination.

More specifically, examples of the fully-aromatic polyamide fibers may include para type polyamide fibers (trade name: Kevlar, Twaron, Technora); examples of the fully-aromatic polyester fibers may include polyarylate fibers (trade name: Vectran, Vecry); examples of the ultrahigh molecular weight polyethylene fibers may include Dyneema (trade name) and Spectra (trade name); examples of the polyvinyl alcohol fibers may include Vinylon (trade name) and Kuralon (trade name); and examples of the heteroaromatic fibers may include polyparaphenylene benzobisoxazole fibers (trade name: Xylon).

Among them preferable one includes fully-aromatic polyester fibers and ultrahigh molecular weight polyethylene fibers. In particular, fully-aromatic polyester fibers are preferable because the fully-aromatic polyester fibers are excellent in cutting resistance, wear resistance, heat resistance, and chemical resistance, and hardly deteriorate their physical property during polishing process.

The single fiber fineness of the high-tenacity organic fiber related to the present invention may be for example about 0.3 to 15 dtex, preferably about 1 to 10 dtex, and especially about 3 to 8 dtex. If the single fiber fineness of the high-tenacity organic fiber is too small, even high-tenacity fibers may be cut by the abrasive grains during polishing. In contrast, if the single fiber fineness of the high-tenacity organic fiber is too large, the textile formed from such fibers may have too large irregularity and fail to make loose grains contact to a workpiece to be polished effectively as well as to make grinding sludge discharged efficiently, resulting in deteriorated polishing rate.

Total fineness of a yarn of the high-tenacity organic fibers may be for example about 3 to 3,000 dtex, preferably about 5 to 1,500 dtex, and especially preferably about 25 to 1,000 dtex. If the total fineness is too small, it may be difficult to weave polishing textiles from such yarns, resulting in increase in cost as well as deterioration of the quality of the textiles. Moreover, since the quality of textiles greatly influences polishing property, such textile may be difficult to use because they may have a disadvantage such that flocks and fluffs may contaminate the texture at the time of weaving. On the other hand, if the total fineness is too large, polishing textiles of such fibers may have too large irregularity or too large range of each concavo-convex size. As a result, the textiles cannot make loose grains efficiently contact to the workpiece, resulting in failing to polish. Further sludge generated during polishing may not be efficiently discharged, resulting in lowering polishing efficiency.

The polishing pad of the present invention is used under high pressure in many cases in order to increase polishing efficiency. Therefore, neither knitting fabric nor nonwoven fabric can be used, because it may be distorted or may be peeled during polishing. Moreover, even if the fibers constituting the polishing pad of the present invention are not modified so as to have a micro-structure such as a porous structure having pores for holding abrasive grains, the polishing pad achieves good polishing.

The weave of the textiles used for the present invention is not limited to a specific one. The weave pattern of the textiles may be plain weave, sateen weave, twill, double cloth, or others so that various textiles can be used. Moreover, the textile may be formed by blending different fibers in combination as bi-color fabric.

Moreover, the textile used in the present invention has a cover factor "K" of 700 to 4,000 represented by the following formula (1). If the textile is a plain weave, the cover factor "K" may be preferably within the range between 800 and 3,000 and more preferably 1,000 and 2,500. If the textile is sateen weave, the cover factor "K" may be preferably within the range between 2,500 and 4,000 and more preferably 3,000 and 3,800.

$$K=N1\times\sqrt{T1}+N2\times\sqrt{T2} \quad (1)$$

N1: Density of warp (yarns/inch)

N2: Density of weft (yarns/inch)

T1: The total fineness of warp (dtex)

T2: The total fineness of weft (dtex)

The textile having a cover factor "K" of less than 700 may slip or allow abrasive grains enter inside the fiber bundles of the textile during polishing, resulting in failing to polishing effectively. In contrast, the textile having a cover factor "K" of over 4,000 may be too difficult to be woven because of too high density of the textile. Such textile may have reduced cushioning property because of too stiff texture, resulting in failing to attain high flatness and high surface quality of a workpiece to be polished.

The textile of plain weave has warps and wefts appearing almost half-and-half on the polishing surface, and may serve as a stiff polishing pad to a certain degree. Accordingly, the textile is suitable for middle polishing because such textile easily allows loose grains to be distributed uniformly and increase polishing rate. The textiles of sateen weave have a woven structure in which the almost entire surface is covered by warps so as to enable to have an enhanced cover factor "K" of warps. Accordingly, the textile of sateen weave is suitable for finishing polish (or final polishing) because such textile enables to provide a dense and elastic polishing pad.

Furthermore, the textile used for the abrasive cloth related to the present invention may be scoured after weaving. Moreover, the textile may be hydrophilized or may be treated with a fabric softener for raising affinity with slurry of abrasive grains. Furthermore, compression processing (for example, calender processing) is effective for textiles to achieve smooth surface of the polishing surface as well as to enhance polishing performance.

Moreover, the polishing pad of the present invention may comprise one or more various layers (e.g., supporting layer) on the non-polishing surface. The polishing pad may comprise, for example, a double-sided tape for fixing the pad to a platen, a PET sheet for enhancing handling ability of the pad, or a cushion layer of a foamed sheet. Moreover, the pad may comprise an adhesive resin or the like for fixing each of the layers.

The polishing system of the polishing pad of the present invention is not limited to a specific one as long as the polishing pad can polish a workpiece in combination with loose grains. The polishing system may be one-side polishing or double-sided polishing conducted in a lapping system or a MCP (Mechano-Chemical Polishing) system, or may be a CMP (Chemical Mechanical Polishing) system, or others.

The loose abrasive grains to be used may be particles such as fine diamond abrasive grains, colloidal-silica abrasive grains, cerium sulfide abrasive grains, and alumina abrasive grains. In particular, a polycrystal diamond abrasive grain is suitable for precision polishing because the diamond crystal decayed during polishing turns into fine abrasive grain particles. Moreover, the average particle size of the abrasive grains may be selected from the wide range between about 1 nm and about 100 μm depending on the purpose, and may be preferably 5 nm to 80 μm and more preferably 10 nm to 50 μm.

Moreover, in the case where the polishing pad of the present invention is used during or after lapping process, the pad is thought to hold abrasive grains between fibers of the textile. Accordingly, it is possible to achieve a desired quality for the polished surface by selecting suitable abrasive grains and by polishing the workpiece at a higher polishing rate.

Further, by using the pad of the present invention, it is possible to reduce the following managements and processes for starting pad work. That is, (i) it is unnecessary for the present polishing pad to manage flatness of the lapping platen whereas it is necessary for conventional lapping platen systems; (ii) usage of the textile pad of the present invention enables to reduce the period required for an initial startup of the polishing pad (hereinafter to be called as seasoning) compared with the conventional polishing pads (nonwoven fabric type, urethane type, suede type, etc.).

Such short seasoning time is very advantageous as compared with the conventional polishing pad, and leads to achieve high efficiency of the work.

(Polishing Machine and Method for Using Polishing Pad)

The present invention also includes a polishing machine comprising the polishing pad as mentioned above. It should be noted that the polishing machine in the present invention refers to any machine applicable to one-side polishing or double-sided polishing conducted by lapping systems or MCP (Mechano-Chemical Polishing) systems, or CMP (Chemical Mechanical Polishing) systems, or others.

For example, one embodiment of the polishing machine of the present invention is described based on FIG. 1. According to FIG. 1, the polishing machine 10 comprises a platen 12, a polishing pad 14 mounted on the platen 12, and a carrier for holding a workpiece 16 to be polished and contacting a surface to be polished 17 of the workpiece 16 with the polishing pad 14 to move relatively with each other, a spindle 20 for driving the carrier 18, and a supply nozzle 24 of an abrasive material containing loose grains. The polishing surface 15 of the polishing pad 14 comprises a textile.

More specifically, the polishing machine 10 may comprise the platen 12 being a disk-like plate, and at least a surface of the platen is planarized to have a substantially flat surface. The platen 12 is mounted in such a manner to be rotated freely about the center of the disk as a rotation axis. The polishing pad 14 is mounted on the platen 12. The machine comprises, above the polishing pad 14, the carrier 18 for holding the workpiece 16 and contacting the surface 17 of the workpiece 16 to the polishing surface 15 of the polishing pad 14 at a predetermined pressure (or pressing the surface 17 to the polishing pad at a predetermined pressure), and the spindle 20 for driving the carrier 18. Further, the machine comprises the supply nozzle 24 for supplying the liquefied abrasive material 22 between the workpiece 16 and the polishing pad, and this abrasive material 22 contains the loose grains. Further, the supply nozzle 24 is connected to a tank (not shown) which stores the abrasive material 22.

As one embodiment of a method of using the polishing pad, the method, for example, comprises supplying loose grains 22 to the polishing pad 14, and rotating the polishing pad 14 relative to the workpiece to be polished with pressing at a predetermined pressure. The polishing pad 14 comprises a polishing surface 15 comprising a textile.

More specifically, the polishing process comprises supplying the abrasive material 22 comprising loose abrasive grains to the polishing pad 14, and rotating the polishing pad 14 relative to the workpiece 16 to be polished with pressing at a predetermined pressure (e.g., 0.05 to 0.5 kgf/cm$^2$) to polish the workpiece 16.

By using the polishing pad (and polishing machine) of the present invention for lapping and/or polishing, it is possible for semiconductor materials with high hardness and metallic materials to attain high flatness and high surface quality with having end face with high precision. Examples of the workpieces to be polished may include (1) monocrystal and polycrystal materials of SiC, sapphire, and various compound semiconductors, (2) materials such as quartz and various ceramics, (3) metal materials such as Cu, SUS, and Ti, and other materials The polishing pad (and machine) of the present invention can be used in all precision polishing and lapping processes which are necessary for high flatness, quality surface, and high precision end face, and can attain the high polishing efficiency.

EXAMPLES

Hereinafter, the present invention will be demonstrated by way of some examples that are presented only for the sake of illustration, which are not to be construed as limiting the scope of the present invention.

[Tenacity and Elastic Modulus]

In accordance with JIS L 1013, the tenacity and elongation at breakage and elastic modulus (the initial tensile resistance) of each sample fiber are obtained on the condition of sample length of 20 cm, initial load of 0.1 g/d, and tension rate of 10 cm/min. in an atmosphere of 25° C. The average value of five or more obtained data was adopted.

Example 1 and Comparative Example 1

A textile of plain weave having a density of 45 warps/inch and 45 wefts/inch was woven from fully-aromatic polyester fiber yarns ("Vectran HT" available from Kuraray Co., Ltd.: single fiber fineness of 5.5 dtex, total fineness of 560 dtex, tenacity of 25 cN/dtex, elastic modulus of 510 cN/dtex). The cover factor "K" of the textile was 2,130.

On one side of the textile was a PET film ("Lumirror" available from Toray Industries, Inc: thickness of 50 μm) laminated with an acrylic binder, then this laminate was circularly stamped out with a Thomson blade to give a polishing pad (A).

In the case of polishing a sapphire substrate used as a substrate for a GaN wafer, lap polishing was performed by using a conventionally-used tin platen and diamond slurry (several species having particle sizes of around 1 μm), followed by final polishing by using a silk textile and colloidal silicas. It took 30 hours for the final polishing process (Comparative Example 1).

On the contrary, when a polishing process using the above-mentioned polishing pad (A) and diamond slurry was interposed between the lap polishing and the final polishing to polish a sapphire substrate in the similar way, it took only 20 hours for the final polishing process (Example 1).

Therefore, the polishing pad (A) being one of the embodiments of the present invention could raise the polishing rate greatly (3 μm/hr), and further could drastically reduce the period for the final polishing process from 30 hours (conventionally-required period) to 20 hours.

Moreover, probably because abrasive grains tended to be pierced between fibers, this polishing pad could reduce the seasoning time from 3 hours (conventionally-required period) to 2.5 hours.

Example 2

The cross section of a SiC substrate comprising a conductive layer (Au, Cu), a solder layer, an insulating layer ($SiO_2$), and a resin layer was polished by using the polishing pad obtained in Example 1 and the diamond slurry (particle size of 15 μm).

Polishing conditions:

The number of rotations: 150 rpm

Polishing load: 2.5 kg/piece

Time: 4 hours

Since this polishing pad had high polishing efficiency, the number of processes for polishing the workpiece could be reduced from nine processes required for by using the conventional various polishing pads to four processes. Moreover, the observation of the cross section of the obtained SiC substrate with a light microscope revealed that the polished surface was very sharp without sagging, and that the SiC substrate, in particular the $SiO_2$ insulating layer, Au electrode, and others was clear enough to observe the cross section of the device.

Example 3

A textile of plain weave having a density of 55 warps/inch and 55 wefts/inch was woven from aromatic polyester fiber yarns ("Vectran HT" available from Kuraray Co., Ltd.: single fiber fineness of 5.5 dtex, total fineness of 220 dtex, tenacity of 26 cN/dtex, elastic modulus of 520 cN/dtex). The cover factor "K" of the textile was 1,632. From this textile a polishing pad was formed in the same way as Example 1.

Moreover, except for using diamond slurry having a particle size of 9 μM, the SiC substrate was polished by using the polishing pad in the same way as Example 1.

As a result, the polishing pad of Example 3 could polish efficiently the SiC substrate with diamond slurry with a small particle size 9 μm probably because the textile comprising the fibers having a small total fineness had a high density. The cross section of the SiC substrate was also vividly observed equivalent to or greater than that in Example 2.

Example 4

The textile obtained in Example 1 was used to polish each of the metallic material of SUS, copper, and Ti by using the lapping machine comprising the textile as a polishing pad. First, the lapping platen of a conventionally used lapping machine was removed from the lapping machine; subsequently the polishing pad obtained in Example 1 was fixed to the place previously held by the lapping platen with double-sided tape. Then the lapping machine was powered to polish the workpiece. It should be noted that the workpiece was polished with diamond slurry having a particle size of 3 μm.

As a result, as for the SUS material and the copper material, the present polishing pad could shorten the time required for finish polishing the materials as compared with lap surface-plate processing performed with the conventional lapping platen.

Moreover, when the Ti metal was polished by using the polishing pad of the present invention in the same conditions as above, the polished surface of the Ti metal could have fewer cracks and higher flatness than the polished surface by using the conventional lapping platen. Furthermore, the present polishing pad could reduce the time required for polishing to almost half compared to the conventional processing.

Since the present polishing pad can be attached to the conventional lapping machine in the simple way, the present invention can be used without special machine reconstruction for adapting the polishing pad to the machine.

Examples 5 to 9 and Comparative Examples 2 and 3

Using three kinds of fully-aromatic polyester fiber yarns ("Vectran HT", single fiber fineness of 5.5 dtex) each having the total fineness of 110 dtex, 220 dtex, and 560 dtex, respectively, the plain weave fabrics having different cover factors "K" with each other were made as shown in Table 1. With the plain weave fabric the polishing pads were produced in the same method as Example 1. (It should be noted that the polishing pad A used in Example 1 was used as the polishing pad of Example 5 and that the polishing pad used in Example 3 was used as the polishing pad of Example 7.

The polishing test of SiC was conducted and estimated in the following conditions by using these polishing pads. The results are shown in Table 1.

[Polishing Test Conditions]

Workpiece to be polished: 2-inch SiC wafer, available from Tannke Blue, lap-finished, the number of micro pipes of less than 50 piece/cm$^2$, thickness of 400 μm Polishing machine: BC-15 available from MAT (desk type compact polishing test device)

Abrasive grain:

Diamond slurry, monocrystal, particle size of 0.1 μm, available from KOMET, 1/10-W2-MA-STD Diamond slurry, polycrystal, particle size of 1 μm, available from KOMET, 1-W2-PC-STD Supply flow rate of slurry: 1 cc/min (cc per minute).

Head load: 0.15 kg/cm$^2$

The number of platen rotations: 40 rpm

The number of polishing head rotations: 39 rpm

Polishing time: 15 minutes

[Evaluation]

Polishing rate: evaluated with the thickness of the substrate with a micrometer (μm/15 min.).

Polishing flaws (scratch): visually evaluated with a digital microscope.

TABLE 1

| Item | | Ex. 5 | Ex. 6 | Ex. 7 | Ex. 8 | Ex. 9 | Com. Ex. 2 | Com. Ex. 3 |
|---|---|---|---|---|---|---|---|---|
| Total fineness(dtex) | | 560 | 110 | 220 | 220 | 560 | 220 | 560 |
| Cover factor "K" | | 2130 | 944 | 1632 | 2373 | 3550 | 682 | 4118 |
| 0.1 μm monocrystal | Polishing rate | 6.2 | 1.6 | 5.4 | 5.9 | 6.4 | 1.3 | Impossible |
| | scratch | None | None | None | None | Few | Few | — |
| 1 μm polycrystal | Polishing rate | 4.2 | 4.6 | 6 | 6.8 | 6.5 | 3.4 | Impossible |
| | scratch | Few | Few | None | None | Few | Many | — |

As shown in Table 1, each of the polishing pads of Examples 5 to 9 can provide good polishing of wafers or provide polishing to such a degree that there is substantially no longer an issue. Among them, the polished workpieces of Examples 7 and 8 had good surface states. In particular, the surface state of Examples 7 was excellent. It should be noted that although the higher polishing rate had been attained in Example 9 even with abrasive grains having the small grain size, generation of a few polishing flaws were found.

Among these polishing pads, there is a tendency that polishing pads having a greater cover factor "K" provide better polishing rate.

The observation of the polishing pad of Comparative Example 2 after polishing process revealed that slips of yarns were occurred in the weave patterns and aggregation of the abrasive grains was found in some voids in the texture. These deficiencies were thought to be the cause of many polishing flaws in the polished workpiece of Comparative Example 2. Moreover, the production of a plain weave fabric was not completed in Comparative Example 3 because of too large cover factor.

Example 10

A textile of five-harness sateen weave having a density of 150 warps/inch and 50 wefts/inch was woven from fully-aromatic polyester fiber yarns ("Vectran HT") having a single fiber fineness of 5.5 dtex and total fineness of 220 dtex as warps and having a single fiber fineness of 5.5 dtex and total fineness of 440 dtex as wefts, respectively. The cover factor "K" of the textile was 3,274. The polishing pad was made in the same way as Example 1 except that the textile surface covered by warps was used as a polishing surface.

This polishing pad was used instead of the pad of the silk textile used in Comparative Example 1 to perform final polishing with the colloidal silica. The polished workpiece by using the polishing pad of Example 10 was obtained with a good surface state in a reduced time required for polishing 30% shorter than that with the polishing pad of the silk textile.

INDUSTRIAL APPLICABILITY

The polishing pad of the present invention can be used in (1) semiconductor-device fields (a silicon diode, a rectifying device, a transistor, a thyristor, a thermistor, a varistor, opto-electric transducer, etc.), (2) integrated-circuit fields (semiconductor integrated circuits (a linear network, calculation circuit, etc.), hybrid integrated circuits (SiP, CoC, etc.), and (3) metalworking industrial field which needs high flatness as well as high precision front face, and can improve polishing efficiency.

As mentioned above, the preferred embodiments of the present invention are illustrated, but it is to be understood that other embodiments may be included, and that various changes or modifications may be made, without departing from the spirit or scope of the present invention.

What is claimed is:

1. A polishing pad for polishing a workpiece to be polished in combination with loose grains, the pad comprising a polishing surface comprising a textile of high-tenacity organic fibers having a tenacity of not lower than 15 cN/dtex, the textile having a cover factor "K" expressed with the following formula (1) of the range between 700 and $4{,}000_1$, $$K=N1\times\sqrt{T1}+N2\times\sqrt{T2} \quad (1)$$

wherein,

N1: Density of warp (yarns/inch)

N2: Density of weft (yarns/inch)

T1: The total fineness of warp (dtex)

T2: The total fineness of weft (dtex).

2. The polishing pad as claimed in claim 1, wherein the high-tenacity organic fiber has a single fiber fineness of 0.3 to 15 dtex.

3. The polishing pad as claimed in claim 1, wherein a yarn of the high-tenacity organic fiber has a total fineness of 3 to 3,000 dtex.

4. The polishing pad as claimed in claim 1, wherein the high-tenacity organic fiber has an elastic modulus of 300 cN/dtex or greater.

5. The polishing pad as claimed in claim 1, wherein the high-tenacity organic fiber comprises a fully-aromatic polyester fiber.

6. The polishing pad as claimed in claim 1, wherein the polishing pad is used in a lapping system, a MCP system, or a CMP system.

7. A polishing machine comprising:

the polishing pad recited in claim 1, a carrier for holding a workpiece to be polished and contacting the workpiece with the polishing pad, and loose abrasive grains supplied to the polishing surface between the polishing pad and the workpiece, wherein the polishing pad and the workpiece are relatively moved in the presence of the loose abrasive grains.

8. A method for using a polishing pad polishing a workpiece to be polished comprising:

contacting the polishing pad recited in claim 1 with a workpiece to be polished, and supplying loose abrasive grains to the polishing surface between the polishing pad and the workpiece, wherein the polishing pad and the workpiece are relatively moved in the presence of the loose abrasive grains.

* * * * *